US006354596B1

(12) United States Patent
Rodriguez

(10) Patent No.: US 6,354,596 B1
(45) Date of Patent: Mar. 12, 2002

(54) POST-TENSION ANCHOR SEAL CAP

(76) Inventor: Alan F. Rodriguez, 3722 Tarrytown Pl., Carrollton, TX (US) 75007

( * ) Notice: Subject to any disclaimer, the term of this patent is extended or adjusted under 35 U.S.C. 154(b) by 0 days.

(21) Appl. No.: 09/546,987

(22) Filed: Apr. 11, 2000

Related U.S. Application Data

(60) Provisional application No. 60/129,259, filed on Apr. 14, 1999.

(51) Int. Cl.[7] ..... F16J 15/00

(52) U.S. Cl. ..... 277/317; 277/605; 277/624; 277/627; 52/223.13; 174/65 G; 174/153 G

(58) Field of Search ..... 277/314, 603, 277/605, 607, 616, 624, 627, 904, 919; 403/248, 249, 280, 282; 52/223.13; 411/425, 426, 427; 174/65 G, 152 G, 153 G, 655 F; 439/345, 346, 271, 274

(56) References Cited

U.S. PATENT DOCUMENTS

| | | | | |
|---|---|---|---|---|
| 4,335,283 A | * | 6/1982 | Migrin | |
| 4,605,272 A | * | 8/1986 | Myers et al. | |
| 4,719,658 A | | 1/1988 | Kriofske | 52/223 L |
| 4,773,198 A | | 9/1988 | Rienhardt | 52/223 L |
| 4,812,624 A | | 3/1989 | Kern | 219/450 |
| 4,821,474 A | | 4/1989 | Rodriguez | 52/223 L |
| 4,918,887 A | | 4/1990 | Davis et al. | 52/223 L |
| 4,977,018 A | * | 12/1990 | Irrgeher et al. | |
| 5,024,032 A | | 6/1991 | Rodriguez | 52/223 L |
| 5,042,337 A | | 8/1991 | Rodriguez | 83/13 |
| 5,058,469 A | | 10/1991 | Rodriguez | 83/13 |
| 5,072,558 A | | 12/1991 | Sorkin | 52/230 |
| 5,072,952 A | * | 12/1991 | Irrgeher et al. | |
| 5,079,879 A | | 1/1992 | Rodriguez | 52/223 |
| 5,263,291 A | | 11/1993 | Knight | 52/223.13 |
| 5,321,220 A | | 6/1994 | Sekiguchi | 200/82 |
| 5,347,777 A | | 9/1994 | Sudduth | 52/223.13 |
| 5,440,842 A | | 8/1995 | Sorkin | 52/223.13 |
| 5,704,771 A | | 1/1998 | Fujisawa et al. | 417/417 |
| 5,755,065 A | | 5/1998 | Sorkin | 52/223.13 |
| 5,777,274 A | * | 7/1998 | Kawase | |
| 5,961,265 A | | 10/1999 | Kato | 411/265 |

* cited by examiner

*Primary Examiner*—Anthony Knight
*Assistant Examiner*—Vismal Patel
(74) *Attorney, Agent, or Firm*—Howison, Chauza, Thoma, Handley & Arnott, L.L.P.; Roger N. Chauza, Esq.

(57) ABSTRACT

A seal cap (10) for use in sealing an end (20) of a tendon (14) anchored to an anchor plate (12). The seal cap (10) includes a receptacle (32) for holding therein a sealing agent (37). The seal cap (10) further includes a push nut (34) that grips to the tendon end (20) when forced thereon. A foam washer (35) is held in the front part of the seal cap (10). When the seal cap (10) is forced, such as by hammering, on the end (20) of the tendon (14), the sealant is displaced onto the tendon (14), and the foam washer (35) is squeezed against the anchor plate (12). A high quality moisture seal is formed.

30 Claims, 2 Drawing Sheets

POST-TENSION ANCHOR SEAL CAP

CROSS REFERENCE TO RELATED APPLICATIONS

This application claims priority to U.S. Provisional Patent Application Ser. No. 60/129,259, filed Apr. 14, 1999.

TECHNICAL FIELD OF THE INVENTION

The present invention relates in general to concrete tensioning apparatus, and more particularly to methods and apparatus for environmentally sealing tendons anchored to an anchor plate.

BACKGROUND OF THE INVENTION

Various techniques exist for placing concrete slabs, floors, beams, and the like, under a tension to thereby strengthen the structure. The placement of a tension assembly in concrete is well known in connection with concrete slabs, such as are used for highways, bridges, floors and foundations. A popular post-tensioning technique is to support or otherwise suspend extruded plastic tubes or sheathes with greased tendons therein at locations that define the center of the concrete slab, when poured. The dead end of each tendon is anchored in an anchor plate at the factory by the conventional use of a pair of wedges. The live or stressing end of the tendons are not anchored at this time. Then, the concrete is poured around the tendon assemblies. After the concrete has been allowed a sufficient time to cure, the tendons are stretched to thereby place the concrete slab in compression. Each tendon is stretched against the near end anchor plate, and then a set of wedges are wedged between the tendon and the anchor plate, thereby leaving the tendon in a tensioned state. The end of the tendon that extends beyond the concrete sidewall is then cut by a torch, a saw blade, shears or other means. In order to protect both ends of the tendon where wedged to the respective anchor plates, the tapered pocket formed in the concrete is grouted in an attempt to environmentally seal the same. While the grouting technique may be effective in certain situations, it is not suitable in other situations. For example, the grout and concrete material itself is not entirely impervious to moisture, thereby allowing some degree of moisture to deteriorate the wedging connection to the tendon. Should such connection deteriorate over time, it is possible that the grip of the wedge on the tendon lets go, thereby releasing the tension in the cable. The significant advantage gained from the tensioned structure is then lost. Should one or more of the tendons become released from its tensioned state, it would not be known as it is difficult to determine when a tendon loses its tension.

In other situations, multiple tensions are run through a metal or plastic duct that extends through the concrete to be held in compression. An anchor plate having multiple anchor devices is utilized at each end of the multiple tendon assembly to thereby provide a combined tension in the concrete structure.

Various plastic caps have been devised by those skilled in the art to provide an environmental seal over the open end of the anchor plate, thereby preventing moisture and other contaminants from coming into contact with the tendon and wedge connection. In all of these end caps, a seal is attempted to be achieved between the end cap and the anchor plate. The most common connection is a mechanical connection of the plastic cap to the anchor plate itself. Because there are many different anchor plate configurations and styles, it becomes necessary to design an end cap that is specialized to mate with the particular style of anchor plate.

A similar problem exists in the fastening and sealing of connecting tubes to the back side of the anchor plates. The connecting tubes provide an interface between the plastic cable sheath and the anchor plate. Traditionally, this has been accomplished by forming the mating end of the plastic connecting tube so that it is friction fit over the base portion of the anchor plate. This neither forms a moisture seal nor a secure engagement of the mated parts. Rather, the connecting tube can be inadvertently pulled away from the anchor plate, there by allowing wet cement to enter into the assembly.

It can be seen that a need exists for an end cap that provides a high quality seal to the tendon end and tendon wedge connection. Another need exists for a seal cap that does not rely on the particular configuration of the anchor plate to achieve a seal of the tendon connection. Another need exists for a cost effective seal cap that is easily installed and with little effort. Another need exists for a cost effective technique for fixing the connecting tubes to the anchor plates and to also form a moisture seal.

SUMMARY OF THE INVENTION

Disclosed is a seal structure that overcomes the shortcomings and disadvantages of the prior art devices. In accordance with the principles and concepts of the invention, a seal cap construction is disclosed for reliably clamping to the tendon itself, rather than to the anchor plate. Disclosed also is a connecting tube that is securely fixed to the anchor plate, but provides a moisture seal therebetween.

In accordance with one embodiment of the invention, the seal cap is constructed of a plastic cap having a cylindrical or other shaped housing to abut against, or otherwise engage with a surface of the anchor plate. The seal cap includes a circular recessed area therein for attachment of a push nut. The seal cap is also constructed to include an internal receptacle for receiving therein the end of the tendon, when the seal cap is forced thereon. The push nut firmly grips the end of the tendon as the seal cap is hammered or otherwise forcefully pushed onto the tendon and into engagement with the anchor plate. Once driven to a home position onto the tendon, the seal cap does not retract whatsoever, thereby maintaining its position locked to the tendon, and in engagement with the anchor plate.

Various corrosion inhibiting mechanisms and sealants can be utilized with the seal cap of the invention. For example, a gel cap, grease, silicone or other sealing material can be placed in the tendon receptacle. Hence, when the seal cap is forced onto the end of the tendon, at least a portion of the corrosion inhibiting material is displaced so as to engulf the tendon end, and the wedge connection to the tendon. Other sealing mechanisms, such as a styrofoam washer, a gasket, O-ring or other rubberized materials can additionally be utilized to seal the skirt or edge of the seal cap to the anchor plate.

Other embodiments may include push nuts that are specially designed and shaped to accommodate the shape of the particular tendon that is utilized. In addition, electrical connections can be made via wires to the push nut so that external electrical access can be made to the tendon for either controlling corrosion thereof or for monitoring the tendon integrity.

According to another embodiment of the seal structure, there is disclosed a connecting tube that is constructed to employ a push nut for engaging with the base of the anchor plate. Much like the seal cap, the connecting tube also includes a closed cell foam washer to provide a seal between the connecting tube and the base of the anchor plate. Once the connecting tube is hammered onto the anchor plate, it is secured thereto and cannot be inadvertently removed.

BRIEF DESCRIPTION OF THE DRAWINGS

Further features and advantages of the preferred and other embodiments of the invention will become apparent from the following and more particular description of the invention, as illustrated in the accompanying drawings, where like reference characters generally denote similar structural elements throughout the views, and in which.

DETAILED DESCRIPTION OF THE INVENTION

Figure 1:
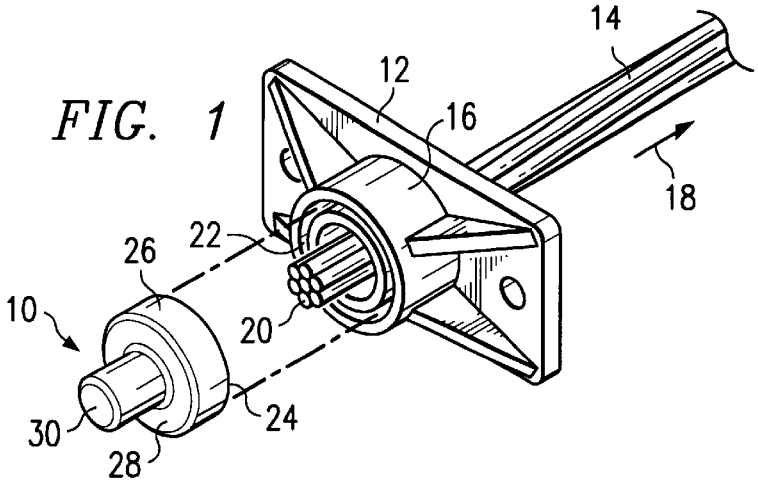
FIG. 1 is an isometric view of a tendon wedged to an anchor plate, and with the seal cap of the invention shown about to be fixed thereto.
Figure 2:
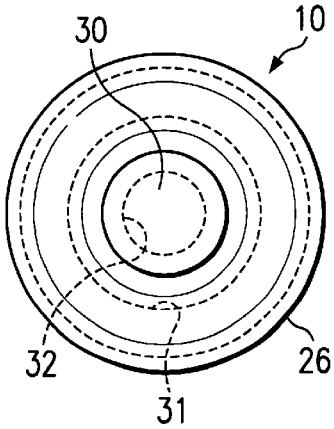
FIGS. 2–4 are respective frontal, side and back views of the preferred embodiment of the seal cap of the invention.

FIG. 1 illustrates as one embodiment of the seal structure a protective cap 10 utilized in conjunction with a conventional anchor plate 12 in which a multi-wire tendon 14 is anchored. While the seal cap 10 of the invention is described in connection with the sealing of the live end of the tendon, the seal cap 10 can be utilized with equal effectiveness at the tendon dead end. The body 16 of the anchor plate 12 includes a bore therethrough that has a conical-shaped interior. The tendon 14 is anchored by a pair of wedges (not shown) to the anchor plate 12 against movement in the direction of arrow 18. The wedges are wedged between the tendon 14 and the inner conical surface of the anchor plate body 16. As is well known in the art, the tendon 14 is initially tensioned by pulling on the live end 20 of the tendon 14 with hydraulic rams, or the like. The wedges are then inserted between the interior conical surface of the anchor plate 12 and the tendon 14, and then the hydraulic ram is released. The stretched tendon 14 exerts a pull in the direction of arrow 18, thereby causing the wedge to anchor the tendon 14 within the anchor plate 12 and maintain a tension on the tendon 14. Once the tendon 14 is tensioned and anchored appropriately, the end 20 of the tendon 14 is cut or sheared, preferably short, so that very little of the end 20 extends beyond the anchor plate body 16.

Figure 3:
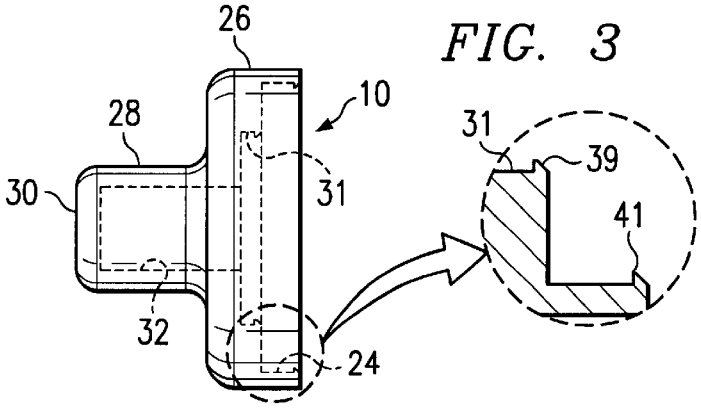
Figure 4:
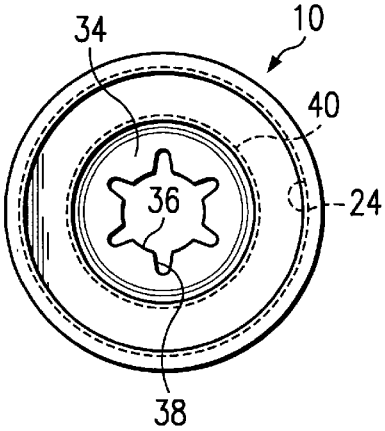

While not required, the particular configuration of the anchor plate 12 includes an annular groove 22. The seal cap 10 of the embodiment shown in FIG. 1 is constructed to provide a cylinder body 26 with an annular edge 24. The annular edge 24 conveniently fits within the annular groove 22 of the anchor plate body 16 shown, but may abut against or over a surface of other types of anchor plates. The end 20 of the tendon 14 fits within a tubular receptacle 28 formed with a closed end 30 of the seal cap 10. While not shown in FIG. 1, the seal cap 10 includes both a mechanism for perfecting an environmental seal to the end 20 of the tendon 14 and to the wedge engagement with the anchor plate 12. The seal cap 10 also includes a mechanism for gripping the tendon end 20 to prevent removal therefrom. With this arrangement, a high quality moisture seal is provided with a seal cap 10 that does not require a clamping, gripping or other similar attachment to the anchor plate 12 itself. One embodiment 10 of the seal cap is shown in FIGS. 2–5. The seal cap 10 is constructed in the preferred form of the invention with a high density polyethylene material. There is shown in FIG. 3 a side view of the seal cap 10. The annular edge or skirt 24 is shaped to fit within the annular groove 22 of the anchor plate body 16. The annular skirt 24 provides a circular area within the frontal portion of the seal cap 10 for receiving therein a sealing washer for providing a water-tight seal to the anchor plate body 16. The tendon end 20 is thus also sealed. The sealing washer 35 can be a closed cell high density polyethylene foam washer that may be somewhat thicker and/or wider than the skirt 24. When the seal cap 10 is forced against the body 16 of the anchor plate 12, the foam washer 35 becomes compressed, thereby providing a moisture-tight seal between the seal cap 10 and the anchor plate 12.

Figure 5:
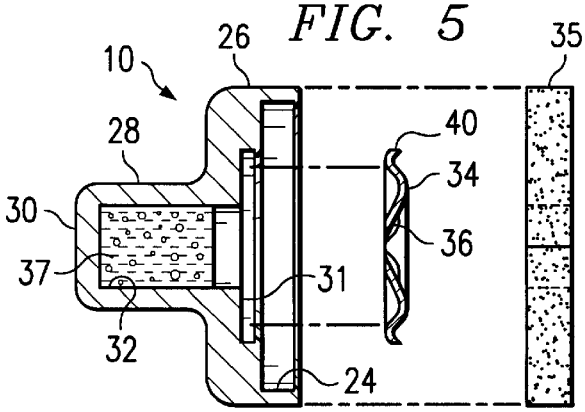
FIG. 5 is a cross-sectional view of the seal cap, with the push nut and compressible washer shown removed therefrom for purposes of clarity.

The seal cap 10 is constructed to include a tubular receptacle 32 for receiving therein the end 20 of the tendon 14. The inside diameter of the receptacle 32 is only a little larger than the tendon. According to an important feature of the invention, the seal cap 10 is forcefully engaged with the tendon end 20 by the use of a push nut 34 shown in FIGS. 4 and 5. The push nut 34 is constructed of a rigid metal and otherwise of conventional design for use in clamping to rods. The push nut 34 typically includes plural ears 36 that extend radially inwardly with respect to the push nut 34. Each ear 36 is separated from adjacent ears by a radial slot 38. This allows each ear to flex independently of the others. As is standard for push nuts 34, the ears 36 are bent axially to a certain degree, as shown in FIG. 5. This allows the push nut 34 to be forced onto an object, but prevents the push nut from being moved in the opposite direction. Should an attempt be made to remove the push nut 34, the ears 36 will only cut deeper into the wire strands of the tendon 14. In practice, the push nut 34 becomes destroyed in the removal thereof.

FIG. 5 also shows the closed-cell foam washer 35 that can be captured within the skirt 24 by reason of an inside annular lip. In the enlarged portion of the seal cap 10 shown in FIG. 3, the annular lip 41 grips to the outer edge of the foam washer 35 shown in FIG. 5 and retains the washer 35 therein during shipping and installation. The foam washer 35 is preferably thicker than the depth of the skirt 24. This allows the foam washer 35 to extend outside the seal cap 10 so that when pushed onto a tendon end 20, the washer 35 is compressed against the body 16 of the anchor plate 12. With this arrangement, the annular edge of the skirt 24 may not engage or otherwise touch the body 16 of the anchor plate 12. Formed through the center of the foam washer 35 are a pair of short cross hair shaped slits. These slits provide an opening in the foam washer so that the end of the tendon can be forced therethrough. The cross hair slits in the foam washer also allow the seal cap 10 to be pushed onto the tendon end 20 a short distance and held there until later hammered to the home position on the tendon. Indeed, a workman can place a number of the seal caps 10 on the tendon ends, and then proceed to hammer them into place. With this construction, a workman need not hold the seal cap 10 with one hand and hammer on it with the other hand. An obvious safety advantage is realized.

FIG. 5 also shows the corrosion inhibiting agent 37 that partially or fully fills the receptacle 32. As will be described below, during installation of the seal cap 10 on the end of a tendon, a substantial portion of the corrosion inhibiting agent 37 is displaced to flow around the area where the push nut 34 grips the tendon. The corrosion inhibiting agent 37 also flows around the other portions of the tendon desired to be protected. In this process, air is displaced from those areas susceptible to corrosion.

The cylinder body 26 of the seal cap 10 includes a circular recessed area 31 for receiving therein the push nut 34. A small annular lip 39 facilitates capture of the metal push nut 34 within the recessed area 31. The lip 39 is shown in the enlargement of FIG. 3. The push nut 34 includes a sharp peripheral edge 40 for engaging with the circular side wall of the recess 31. Hence, when the push nut 34 is forcefully pushed into the recess 31 of the seal cap body, it remains engaged therein behind the lip 39 and cannot be pulled out. This is due to the engagement by the sharp annular edge 40 of the push nut 34 with the circular wall of the recess 31, as well as the annular lip 39. When the push nut 34 is installed within the seal cap 10, it cannot be removed therefrom except by destruction of either the cylinder body 26 or the push nut 34. Preferably, the metal push nut 34 is pressed into the recess 31 of the plastic seal cap shortly after molding thereof, when the plastic is yet pliable and formable. Once pressed fully into the recess 31, the plastic material cools and shrinks sufficiently to form the rib 39 which captures the push nut 34 therein.

The sealing mechanism utilized with the seal cap 10 can be of various configurations, or combinations thereof. In one form of the invention, and as noted above, a flexible closed cell foam washer 35 can be inserted as a seal within the annular skirt 24 so that when pushed against the face of the anchor plate body 16, a moisture seal is achieved. Other types of seals can be made of rubber and elastomer materials. Various types of corrosion inhibitors and sealants such as greases, silicone compositions, gels, or the like, can be utilized to prevent corrosion of the tendon end 20. Those skilled in the art may prefer to load the tubular receptacle 32 of the seal cap 10 with a grease or other corrosion preventing compound. With this configuration, when the seal cap 10 is forced onto the end 20 of the tendon 14, the grease within the receptacle 32 will be displaced and flow outwardly around both the tendon and the wedge connection. A voidless encapsulation of the same is achieved. The flow of the corrosion inhibiting agent 37 from the receptacle 32 around the tendon becomes accelerated because of the small annular space between the receptacle 32 and the tendon. The flow of the corrosion inhibiting agent 37 is effective to displace air in the wedge cavity and around the tendon. Also, because the receptacle 32 is only a little larger than the tendon, a substantial portion of the sealant 37 contained within the tubular receptacle 32 is displaced outwardly onto the tendon. This provides a high quality and long term corrosion resistant coating to the tendon end 20.

Yet other sealing mechanisms may be utilized, such as a silicone or rubberized material being disposed within the tubular receptacle 32 and sealed with a membrane before attachment of the push nut 34 within the circular recess 38. When utilizing a membrane (not shown), the sealant held within the receptacle 32 can be of the type that sets or otherwise cures once the membrane is broken by the tendon end 20 being forced into the receptacle 32. The use of a corrosion inhibitor in the seal cap 10 is particularly important when the seal cap is forced onto the end 20 of the tendon 14. When forced onto the tendon end 20, the push nut 34 scrapes the preexisting grease off the tendon wires. However, when the corrosion inhibiting agent 37 within the receptacle 32 is displaced by the tendon end 20, such agent recoats the tendon end 20 to thereby preserve the corrosion resistance of the structure.

From the foregoing construction of the seal cap 10, it can be seen that a high quality environmental seal is achieved. Moreover, the installation of the seal cap 10 to the end 20 of the tendon 14 is easy, safe and requires no special tools nor a high degree of skill. The seal cap 10 is simply registered with the tendon end 20 and pushed so that the tendon end enters the foam washer slits. The workman can then let go of the seal cap 10. Thereafter, the workman simply applies a force to the closed end 30 of the seal cap 10, such as by hammering. As can be appreciated, the ears 36 of the push nut 34 are deformed as the seal cap 10 is forced into engagement on the end 20 of the tendon 14. The seal cap 10 is hammered to a home position, where the foam washer 35 is squeezed as it abuts against the anchor plate body. Once the seal cap 10 is forced to its home position, it does not retreat at all, thereby maintaining the seal that is established. The outer face surface of the foam washer 35 may or may not have an adhesive on the outer surface thereof so that it adheres to the anchor plate.

In accordance with an important feature of the invention, the seal cap 10 can be constructed so as to mate with many configurations of anchor plate bodies 16. It is well known that many different types of anchor plates are available, and thus the shape of the seal cap 10 can be made to accommodate the same.

It should be noted that the end 20 of the tendon 14 need not be specially prepared for accommodating the push nut 34 fixed within the seal cap 10. Indeed, even when the end 20 of the tendon 14 is cut by a torch, which leaves a slightly mushroomed end, the ears 36 of the push nut 34 will deform sufficiently when pushed over the mushroomed edge, and thereafter engage the individual wires in a gripping manner. Push nuts can nonetheless be specially adapted for use with torch-cut tendon ends. The ears 36 can be made radially longer to provide a greater degree of flexibility when forced over the rough torch-cut end. To that end, the radial slots 38 can be made longer.

Figure 6:
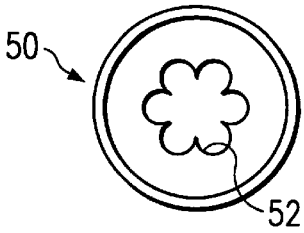
FIG. 6 is another embodiment of the push nut of the invention.

FIG. 6 illustrates another embodiment of a push nut 50. This embodiment is similar to the push nut 34 shown in FIG. 4, except with a different configuration of the ears. The cut out 52 in the push nut 50 is shaped much like the outer surface of a seven-wire tendon 14. A seven-wire tendon has six wires around a central wire. Accordingly, the cut out 52 of the push nut 50 includes six circular lobes. The cut outs 52 thus fits over the respective outer wires of the tendon. In order to allow the circular cut outs to flex more, radial slots (not shown) can be formed therein.

Figure 7:
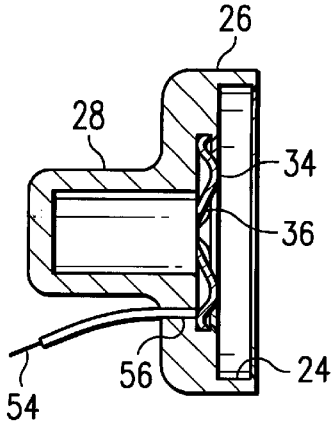
FIG. 7 is a cross sectional view of another embodiment of the seal cap, with electrical connections made to the push nut.

FIG. 7 is a cross-sectional view that depicts another embodiment of the seal cap of the invention. Here, the push nut 34 is connected to a wire 54 that is fed through a hole 56 in the cylinder body 26 of the seal cap 10. The wire 54 is sealed in the hole 56 to prevent moisture from entering the interior of the seal cap 10. An electrical current can be coupled to the push nut 34, via the wire 54, and thus to the tendon 14. Corrosion control of the post-tensioned apparatus can thus be easily monitored and controlled.

Figure 8:
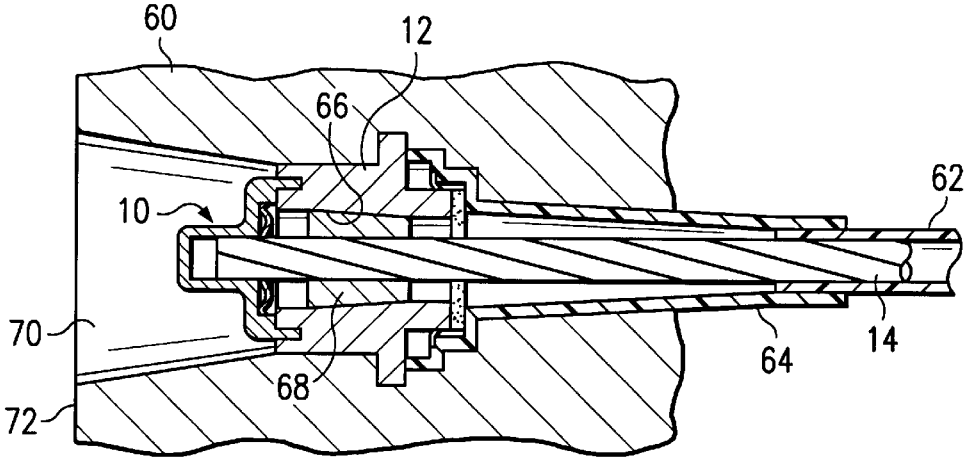
FIG. 8 is a cross sectional view of a tensioned tendon fixed by a wedge connection to an anchor plate, which anchor plate is fixed within the concrete material, and with the seal cap of the invention shown sealing the wedge connection.

FIG. 8 illustrates the seal cap 10 fully installed on the end 20 of the tendon 14 and gripped thereto. For purposes of clarity, the seal mechanism for the seal cap 10 is not shown. In a typical use of the anchor plate apparatus for the post tensioning of concrete, the apparatus of FIG. 8 is utilized at one end of the tendon 14. It should be understood that a similar anchor bracket apparatus is utilized at the other end of a concrete slab, or the like, so that when a tension is created and maintained on the tendon 14, the concrete slab disposed therebetween is maintained in compression.

The anchor plate 12 is anchored within the concrete 60 and prevented from movement in either axial direction because the anchor plate 12 is imbedded within the concrete 60. The tendon 14 is movable within a plastic sheath 62 during tensioning, which sheath extends throughout the cement slab. A connecting tube member 64 couples the sheath 62 to the anchor plate 12 so that wet concrete does not engulf the tendon 14. As noted above, the anchor plate 12 includes a cone-shaped interior surface 66. A pair of wedges 68 function to wedge the tendon 14 against the conical surface 66 to prevent movement of the tensioned tendon 14 to the right. An outer cone-shaped pocket 70 is formed in the concrete 60, and opens to a side surface 72 of the concrete slab. The pocket 70 is filled with a grout or cement to thereby provide a smooth exterior surface once the anchor operation is completed. As noted above, cement and grout do not always provide a water or moisture-proof seal, thereby necessitating a primary sealing mechanisms, such as the seal cap 10 of the invention.

Figure 9:
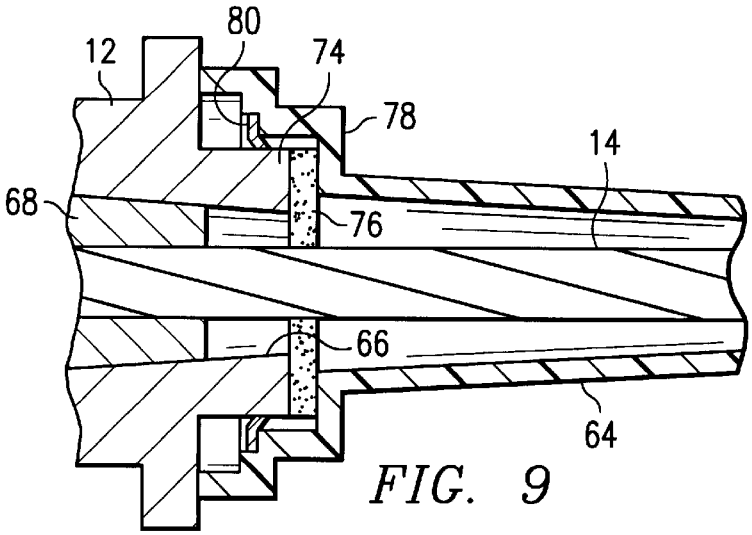
FIG. 9 is an enlarged cross-sectional view of a portion of the tendon assembly shown in FIG. 8, showing the secure engagement of the connecting tube to the base of the anchor plate.

In accordance with an important feature of the invention, the connecting tube 64 is constructed to also be mechanically locked to the base 74 of the anchor plate 12. The seal cap 10 is clamped to the tendon end at the front of the anchor plate 12, whereas the connecting tube 64 is clamped to the back side of the anchor plate 12. This is shown in FIG. 9. The connecting tube 64 is constructed to also provide a moisture seal to the anchor plate base 74 by the utilization of a closed cell foam washer 76. The foam washer 76 is axially squeezed between the end of the anchor plate base 74 and the shouldered portion 78 of the connecting tube 64. The connecting tube 64 is mechanically locked to the anchor plate base 74 by the utilization of a push nut 80. The push nut 80 is snap fit within a recessed area formed in the connecting tube 64, much like the engagement described above in connection with the seal cap 10. The push nut 80 is forced onto the anchor plate base 74 when the connecting tube 64 is forced to the left of the drawing into engagement with the anchor plate base 74. The deformation of the ears of the push nut 80 when forced onto the base 74 provides a secure mechanical lock of the two parts together. A slotted slide hammer can be utilized to hammer the connecting tube 64 and push nut 80 into a locked engagement on the anchor plate base 74.

The foregoing illustrates that the seal cap 10 of the invention relies on attachment by gripping, via a push nut 34 to the tendon 14 itself, rather than relying on attachment of the seal cap 10 directly to the anchor plate 12. The seal cap 10 includes a sealing agent that seals the wedge connection from moisture. Moreover, the seal cap 10 is easily installed on the end 20 of the cable by a workman to thereby achieve a high quality seal. The seal cap 10 can also be utilized on multi-tendon anchor plates, such as utilized on bridge structures. In accordance with another feature, a connecting tube 64 that mates with the end of the cable sheath 62 also fastens to the base 74 of the anchor plate 12 by the use of a push nut 80. This simplifies the operation and provides a secure and sealed attachment of the parts together.

While the foregoing embodiments of the invention have been described in connection with the details thereof, it is to be understood that further modifications may be made by those skilled in the art, without departing from the spirit and scope of the invention, as defined by the appended claims.

I claim:

1. A seal structure for use in sealing tendons utilized with post-tensioning anchor plates, comprising:

a seal body for receiving therein at least a portion of the tendon; and a locking mechanism fixed within said seal body for locking said seal body with respect to said anchor plate, said locking mechanism having an opening therein for gripping to a structure to be locked thereto.

2. The seal structure of claim 1, wherein said locking mechanism comprises a push nut.

3. The seal structure of claim 2, wherein said push nut is adapted for locking to the tendon.

4. The seal structure of claim 2, wherein said push nut is adapted for locking to the anchor plate.

5. The seal structure of claim 2, wherein said push nut has a cut out configuration for conforming to a multi-wire tendon.

6. The seal structure of claim 3, wherein said push nut is constructed of metal, and further including a conductor providing an electrical connection to said push nut.

7. The seal structure of claim 1, wherein said seal body includes a cylindrical body of a first diameter, and a receptacle of a smaller diameter for receiving therein an end of the tendon.

8. The seal structure of claim 7, further including a sealant disposed in said receptacle so that when said seal body is pushed on said tendon and said tendon end enters said receptacle, said sealant is forced out of said receptacle onto said tendon.

9. The seal structure of claim 8, wherein said sealant comprises a material that is initially flowable, but sets to a different state after a period of time subsequent to installation of said seal structure on the end of the tendon.

10. The seal structure of claim 8, further including a membrane for sealing said sealant within said receptacle.

11. The seal structure of claim 1, further including a compressible washer for providing a seal between said seal body and the anchor plate.

12. The seal structure of claim 11, wherein said compressible washer is constructed of a closed-cell foam.

13. The seal structure of of claim 2, wherein said push nut is captured within said seal body so that once said seal body is locked with respect to the anchor plate, said seal body cannot be easily removed.

14. The seal structure of claim 13, wherein said push nut has a sharp outer annular edge that engages with said seal body to prevent separation therebetween once engaged.

15. The seal structure of claim 3, wherein said seal structure defines a seal cap.

16. The seal structure of claim 4, wherein said seal structure defines a connecting tube.

17. A method of sealing an end of a tendon in a post-tension anchor plate, comprising the steps of:

positioning a seal cap adjacent to an end of the tendon;

hammering the seal cap onto the end of the tendon until the seal cap is sealed against a surface of the anchor plate; and using a tendon gripping mechanism fixed to said seal cap for gripping onto the tendon.

18. The method of claim 17, further including using a push nut as said tendon gripping apparatus.

19. The method of claim 17, further including using a moisture seal with said seal cap so that when said seal cap is pushed against said anchor plate, a seal is achieved between said anchor plate and said seal cap.

20. The method of claim 17, further including displacing a flowable sealant when said seal cap is inserted on to the tendon end, whereby said sealant flows onto said tendon.

21. The method of claim 17, further including positioning said seal cap on said tendon end by inserting said tendon into a slot formed in a material attached to said seal cap.

22. A seal cap for use in sealing tendons utilized with post-tensioning anchor plates, comprising:

a plastic seal cap having a cylindrical skirt portion and a tubular receptacle portion with an outer end of the receptacle being closed and suitable for hammering thereon, said seal cap further including a recess formed therein;

a metal push nut adapted for engagement in said recess so as to be captured therein; and a seal washer having at least a portion thereof insertable into said cylindrical skirt portion.

23. The seal cap of claim 22, further including a sealant disposed in said tubular receptacle.

24. The seal structure of claim 1, wherein said opening in said locking mechanism is adapted for locking to said tendon.

25. The seal structure of claim 1, wherein said opening in said locking mechanism is adapted for locking to said anchor plate.

26. A seal cap for use in sealing tendons utilized with post-tensioning anchor plates, comprising:

a plastic seal cap for receiving therein an end of said tendon, said plastic seal cap having formed therein a recess, said recess having a radially inwardly formed lip, said plastic seal cap further including a skirt;

a push nut having an opening therein for locking to the tendon when forced thereon, said push nut being captured within the recess of said plastic seal cap by said lip so as to prevent separation of the push nut from said plastic seal cap; and a deformable washer insertable at least partially into the skirt of said plastic seal cap, whereby when said plastic seal cap is forced onto the tendon until said deformable washer is pressed in a sealed manner to said anchor plate, said push nut is correspondingly forced onto the tendon to thereby lock said seal cap onto the tendon and to seal said plastic seal cap to the anchor plate.

27. The seal cap of claim 26, further including a radially inwardly formed lip for holding the deformable washer within the skirt of said plastic seal cap.

28. The seal cap of claim 26, wherein said deformable washer is constructed of a foam-type material.

29. A seal cap for use in sealing tendons utilized with post-tensioning anchor plates, comprising:

an enclosure for receiving therein an end of a multi-wire tendon, an outer surface of said multi-wire tendon characterized by valleys between each wire;

a lock nut housed within said enclosure; and said lock nut having an opening therein, and said opening having projections that project into said valleys to thereby provide an increased area of engagement between said lock nut and the tendon.

30. The seal cap of claim 29, wherein said projections comprise pointed tangs.

* * * * *